US009343847B2

(12) United States Patent
Hashimoto et al.

(10) Patent No.: US 9,343,847 B2
(45) Date of Patent: May 17, 2016

(54) MATING COAXIAL CONNECTORS HAVING ANTI-ROTATIONAL FEATURES

(71) Applicant: DAI-ICHI SEIKO CO., LTD., Kyoto (JP)

(72) Inventors: Yoshimitsu Hashimoto, Fukuoka (JP); Shogo Jinnouchi, Fukuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/504,578

(22) Filed: Oct. 2, 2014

(65) Prior Publication Data

US 2015/0099391 A1 Apr. 9, 2015

(30) Foreign Application Priority Data

Oct. 7, 2013 (JP) ..... 2013-210358

(51) Int. Cl.

| | |
|---|---|
| ***H01R 13/64*** | (2006.01) |
| ***H01R 13/629*** | (2006.01) |
| ***H01R 24/58*** | (2011.01) |
| ***H01R 13/631*** | (2006.01) |
| ***H01R 24/86*** | (2011.01) |

(52) U.S. Cl.

CPC ..... *H01R 13/629* (2013.01); *H01R 13/631* (2013.01); *H01R 24/58* (2013.01); *H01R 24/86* (2013.01)

(58) Field of Classification Search

CPC .... H01R 24/38; H01R 24/58; H01R 13/6277; H01R 9/05

USPC ..... 439/380, 332, 378, 578, 675

See application file for complete search history.

(56) References Cited

U.S. PATENT DOCUMENTS

| | | | | |
|---|---|---|---|---|
| 4,106,839 | A * | 8/1978 | Cooper | H01R 13/65802 439/607.18 |
| 6,408,706 | B1 * | 6/2002 | Nagai | F16C 29/02 384/29 |
| 7,744,392 | B2 * | 6/2010 | Khemakhem | H01R 24/46 439/188 |
| 8,550,843 | B2 * | 10/2013 | Van Swearingen | H01R 9/05 439/317 |
| 2003/0086664 | A1 * | 5/2003 | Moisel | G02B 6/4277 385/101 |
| 2005/0173395 | A1 | 8/2005 | Haussner et al. | |
| 2012/0137842 | A1 * | 6/2012 | Guo | F16B 23/003 81/460 |
| 2014/0241794 | A1 * | 8/2014 | Sim | E04B 1/5831 403/349 |

FOREIGN PATENT DOCUMENTS

| | | |
|---|---|---|
| JP | 58-192487 | 12/1983 |
| JP | 6-84684 | 12/1994 |
| JP | 9-35825 | 2/1997 |
| JP | 9-306603 | 11/1997 |
| JP | 2005-207730 | 8/2005 |

* cited by examiner

*Primary Examiner* — Vanessa Girardi

(74) *Attorney, Agent, or Firm* — Wenderoth, Lind & Ponack, L.L.P.

(57) ABSTRACT

An electric connector includes a first housing including a guide shaft and a second housing including a guide hole into which the guide shaft is inserted. The guide shaft includes a main body, and a projection radially projecting from the main body, the guide hole being formed at an inner surface thereof with a groove into which the projection is fit. The projection and the groove are formed such that a first imaginary line intersects with a second imaginary line, the first imaginary line being defined by extending a contact plane at which the projection and the groove make contact with each other when the first housing rotates relative to the second housing, towards a center of the main body. The second imaginary line is defined as a line bisecting a top surface of the projection and extending towards a center of the main body.

11 Claims, 16 Drawing Sheets

MATING COAXIAL CONNECTORS HAVING ANTI-ROTATIONAL FEATURES

BACKGROUND OF THE INVENTION

1. Field of the Invention

The invention relates to an electric connector including a first housing of a male connector, and a second housing of a female connector into which the first housing is fit.

2. Description of the Related Art

An electric connector, such as a connector used for a glow plug igniting and/or pre-heating an engine and a connector connecting a combustion-pressure sensor and a wire harness to each other, generally includes a cylindrical male connector. Since the male connector is designed to be symmetrical in rotation relative to a female connector, the male connector can be fit into the female connector even if the male connector is rotated in any direction around an axis of the male connector. Thus, the male connector can be readily fit into the female connector even manually, even if those connectors are located at a place where an operator cannot see the connectors.

FIG. 15 illustrates the electric connector suggested in Japanese Patent Application Publication No. H9 (1997)-35825.

The illustrated electric connector includes a plug connector 1000 and a receptacle connector 1010. The plug connector 1000 includes a plug insulator 1001 having a rotation-symmetry shape, and a plurality of contacts 1002 each situated at different distances from a distal end of the plug insulator 1001. The receptacle connector 1010 is formed with a hole 1011 into which the plug connector 1000 can be inserted. When the receptacle connector 1010 is fit into the hole 1011, contacts 1012 face an inner surface of the hole 1011.

FIG. 16 is a cross-sectional view of the glow plug suggested in Japanese Patent Application Publication No. 2005-207730, and FIG. 17 is a perspective view of the glow plug.

The illustrated glow plug includes an electrically insulated casing 1100, sensor terminals 1101 to 1103 arranged outside and inside of the casing 1100, and a connector 1104. The sensor terminals 1101 to 1103 make electrical contact with sensor-connectors of a sensor (not illustrated) of a connector (not illustrated) when the glow plug is fit into the connector. The connector 1104 is electrically connected to a terminal of a heater of the glow plug when the glow plug is fit into the connector.

The conventional electric connectors illustrated in FIGS. 15 to 17 have an advantage that a male connector can be fit into a female connector even if the male connector is axially rotated in any direction. However, the conventional electric connectors are accompanied with a problem that if they are oscillated or they receive impact when a male connector is fit into a female connector, one of the connectors is forced to axially rotate, resulting in that the one of the connectors gradually retreats, and thus, the male connector might be released from the female connector. The male and female connectors may be formed with a projection and a recess into which the projection can be fit, respectively, in order to prevent the male and female connectors from axially rotating. However, if an intensive force acts on the male and female connectors in a direction of the axial rotation, the projection would be collapsed, resulting in that one of the male and female connectors makes relative axial rotation. Thus, the conventional electric connectors are accompanied with a problem of deterioration in reliability to electrical connection between the male and female connectors.

SUMMARY OF THE INVENTION

In view of the above-mentioned problems in the conventional electric connectors, it is an object of the present invention to provide an electric connector capable of having an increased proof stress to axial rotation to thereby enhance reliability to electrical connection between male and female connectors.

In one aspect of the present invention, an electric connector includes a first housing including a guide shaft, and a second housing including a guide hole into which the guide shaft is inserted. The guide shaft includes a main body, and at least one projection radially projects from the main body. The guide hole is formed at an inner surface thereof with at least one groove into which the projection is fit, and the projection and the groove are formed such that a first imaginary line intersects with a second imaginary line. The first imaginary line is defined by extending a contact plane at which the projection and the groove make contact with each other when the first housing rotates relative to the second housing, towards a center of the main body, and the second imaginary line is defined as a line bisecting a top surface of the projection and extending towards a center of the main body.

In the electric connector in accordance with the present invention, the first imaginary line is designed to intersect with the second imaginary line. Thus, the projection has a surface inclining away from the second imaginary line from a lower end towards an upper end thereof, ensuring that the projection and the groove can be kept to be fit into each other.

In a preferred embodiment, the first imaginary line intersects with the second imaginary line between the projection and the center of the main body.

This embodiment ensures that the projection is hard to be collapsed when one of the housings axially rotates, because the projection bites into the groove.

It is preferable that the first imaginary line intersects with the center of the main body.

It is preferable that the guide shaft includes a plurality of projections, and the guide hole is formed with a plurality of grooves, the projections being equally spaced away from adjacent ones, and the grooves being equally spaced away from adjacent ones.

It is possible to equally disperse a stress exerted by the projection on the groove when the first housing axially rotates.

For instance, the first housing comprises a housing of a male connector, and the second housing comprises a housing of a female connector, in which case, the guide shaft extends in the first housing, and the guide hole is formed along an axis of a shaft extending in the second housing.

When the first housing is inserted into the second housing, even if the first housing is attempted to be inserted in an inclined condition into the second housing, the first housing can be accurately inserted into the second housing by inserting the guide shaft into the guide hole, because the guide shaft is guided along the guide hole. Furthermore, the combination of the projection and the groove prevents the guide shaft from axially rotating when the guide shaft is to be inserted into the guide hole.

It is preferable that the projection has an arcuate top surface, in which case, since the arcuate projection can be thicker at a summit thereof than a flat projection, the projection can have an increased strength.

It is preferable that the first imaginary line and a third imaginary line connecting an outermost end of the projection and the center of the main body with each other form an angle in the range of 10 and 30 degrees both inclusive.

It is preferable that the contact plane and the top surface of the projection form an acute angle.

Another aspect of the present invention relates to a combination of a shaft and a hole into which the shaft can be inserted. The shaft includes a main body, and at least one projection radially projects from the main body. The hole is formed at an inner surface thereof with at least one groove into which the projection is fit, and the projection and the groove are formed such that a first imaginary line intersects with a second imaginary line. The first imaginary line is defined by extending a contact plane at which the projection and the groove make contact with each other when the shaft rotates relative to the hole, towards a center of the main body, and the second imaginary line is defined as a line bisecting a top surface of the projection and extending towards a center of the main body.

The advantages obtained by the aforementioned present invention will be described hereinbelow.

In the electric connector in accordance with the present invention, the projection has a surface inclining away from the second imaginary line from a lower end towards an upper end thereof, ensuring that the projection and the groove can be kept to be fit into each other. Thus, the electric connector in accordance with the present invention can have an increased proof stress or resistance to axial rotation, resulting in enhancement in reliability to electrical connection between the first and second housings.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 1:
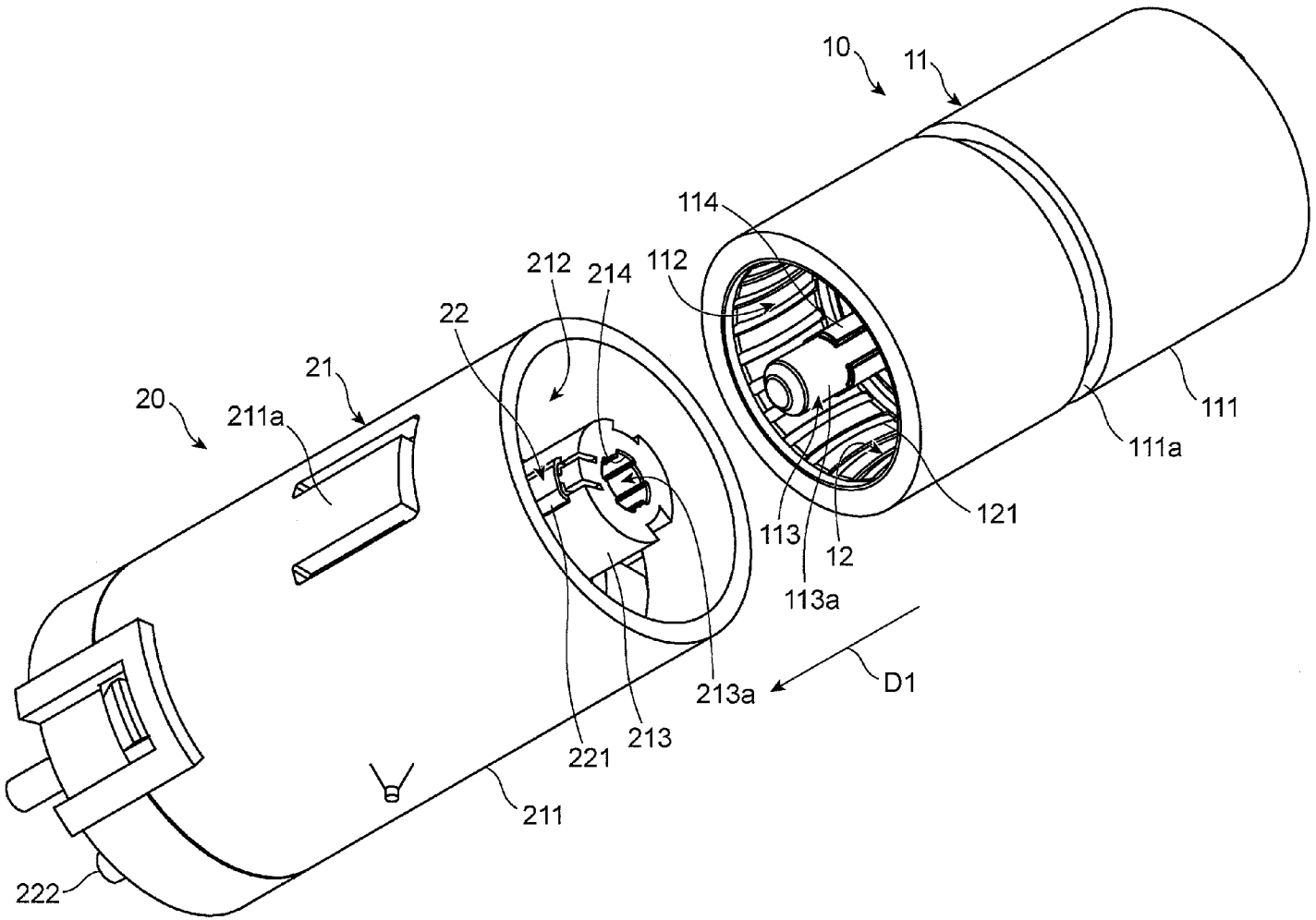
FIG. 1 is a perspective view of the electric connector including a male connector and a female connector, in accordance with the preferred embodiment of the present invention.

FIG. 1 is a perspective view of the electric connector in accordance with the preferred embodiment of the present invention.

As illustrated in FIG. 1, the electric connector includes a male connector 10 and a female connector 20.

The male connector 10 and the female connector 20 are used for connecting various kinds of sensors to a wire harness, for instance.

First, the male connector 10 is explained hereinbelow.

Figure 2:
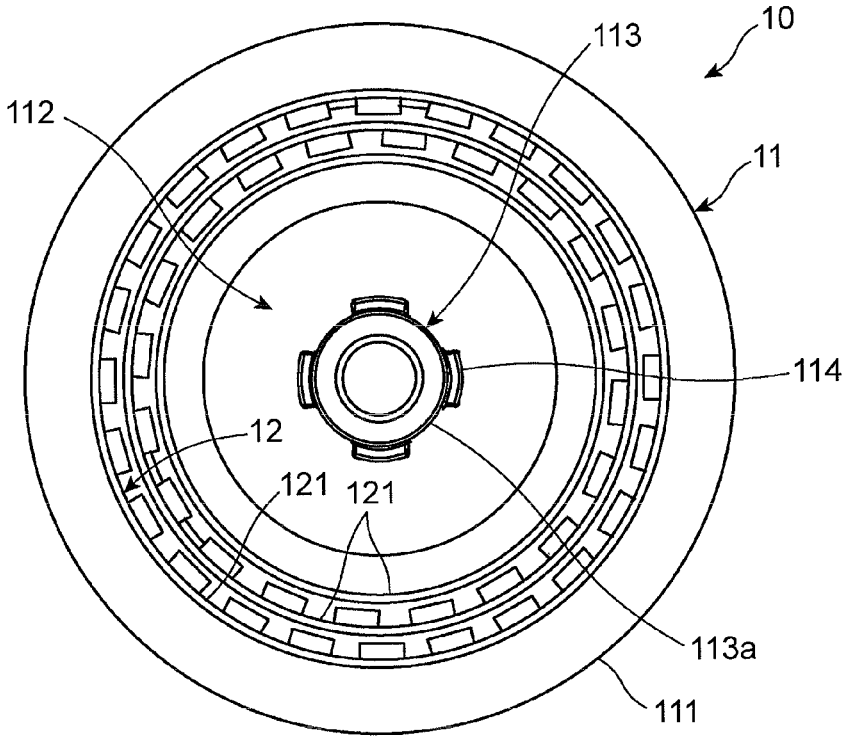
FIG. 2 is a front view of the male connector.
Figure 3:
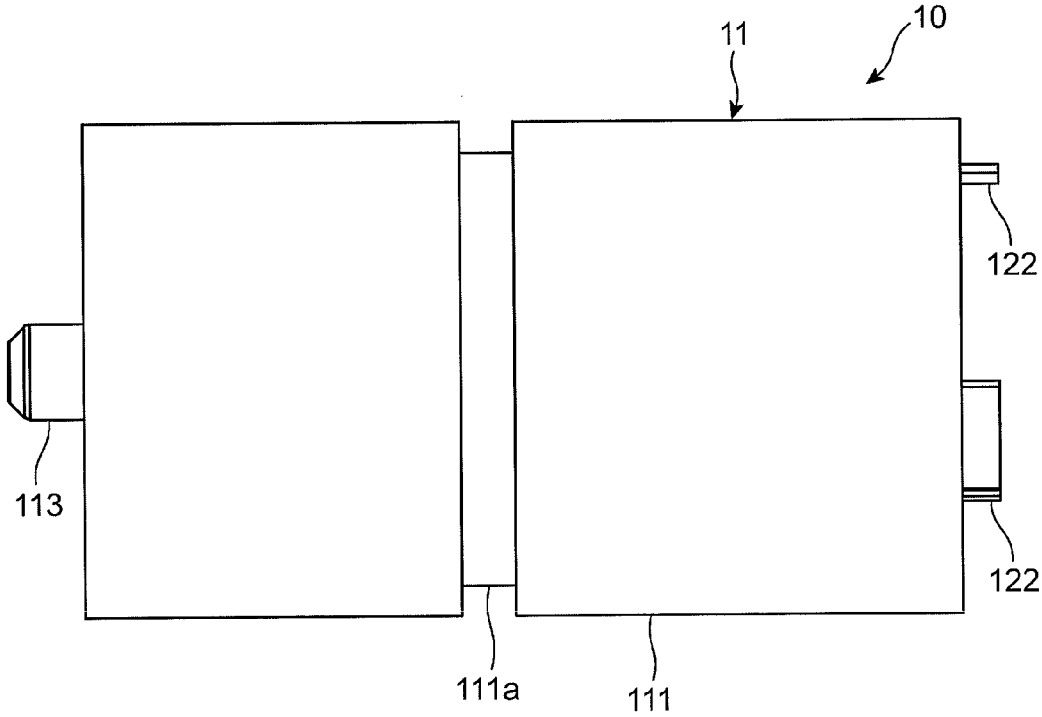
FIG. 3 is a right side view of the male connector.

As illustrated in FIGS. 1 to 3, the male connector 10 includes a male housing 11 to be fit into the female connector 20, and three male contact terminals 12 electrically connecting the male connector 10 to the female connector 20.

The male housing 11 includes a cylindrical main body 111 open at one end and closed at the other end to thereby define a hollow space 112 therein, and a guide shaft 113 extending in the hollow space 112 in a direction D1 in which the male connector 10 is fit into the female connector 20.

Figure 7:
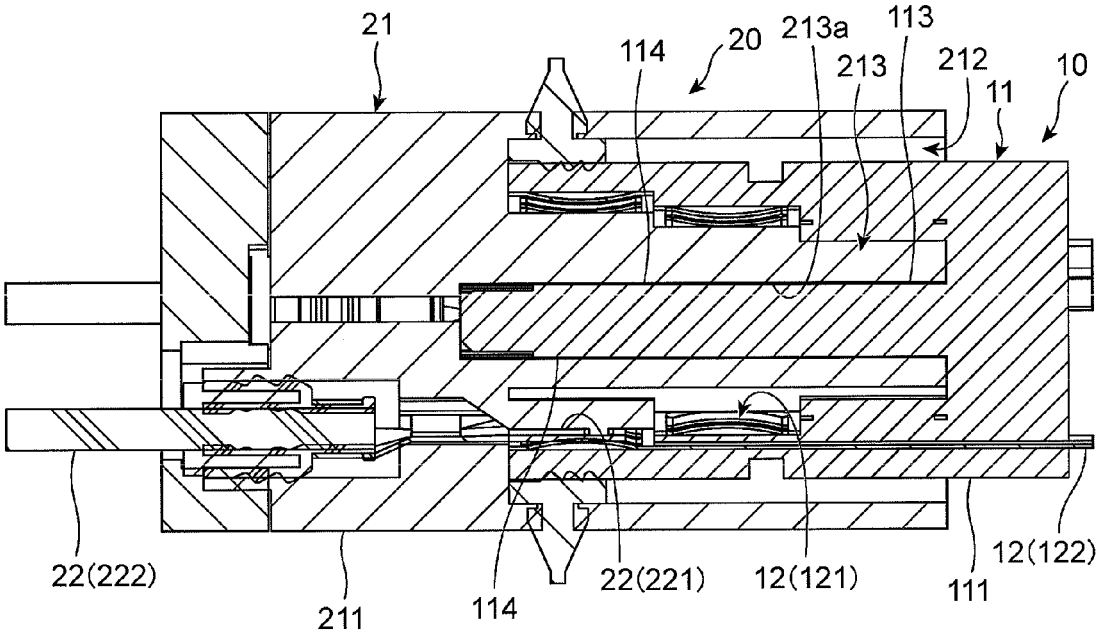
FIG. 7 is a lateral cross-sectional view of the male and female connectors fit into each other.

The main body 111 is formed at a center in a length-wise direction and circumferentially thereof with an annular groove 111*a*. The hollow space 112 has three cylindrical inner areas. As illustrated in FIG. 7, the inner area located nearer to a bottom of the housing 11 is designed to have a smaller inner diameter.

The guide shaft 113 has a main body 13*a* with a circular cross-section, and is coaxial with the hollow space 112. As illustrated in FIG. 2, the guide shaft 113 is formed at an outer surface thereof and circumferentially around an axis thereof with four projections 114 equally spaced apart from each other. Specifically, the projections 114 are located at every 90 degrees around the central longitudinal axis of the guide shaft 113. Each of the projections 114 has a length starting from a location away from a top end of the guide shaft 113 and extending in a direction opposite to the direction D1. The guide shaft 113 outwardly extends beyond the male housing 11, as illustrated in FIG. 3.

Each of the three male contact terminals 12 makes mechanical and electrical contact with a later-mentioned female contact terminal. In line with the hollow space 112 having the three inner areas having inner diameters different from one another, each of the male contact terminals 12 includes a cylindrical contact 121 having an inner diameter different from the same of the other cylindrical contacts, and a connector 122 (see FIG. 3) extending outwardly of the male housing 11 from an end of the contact 121. Each of the contacts 122 is connected to a cable (not illustrated).

The female connector 20 is explained hereinbelow.

Figure 4:
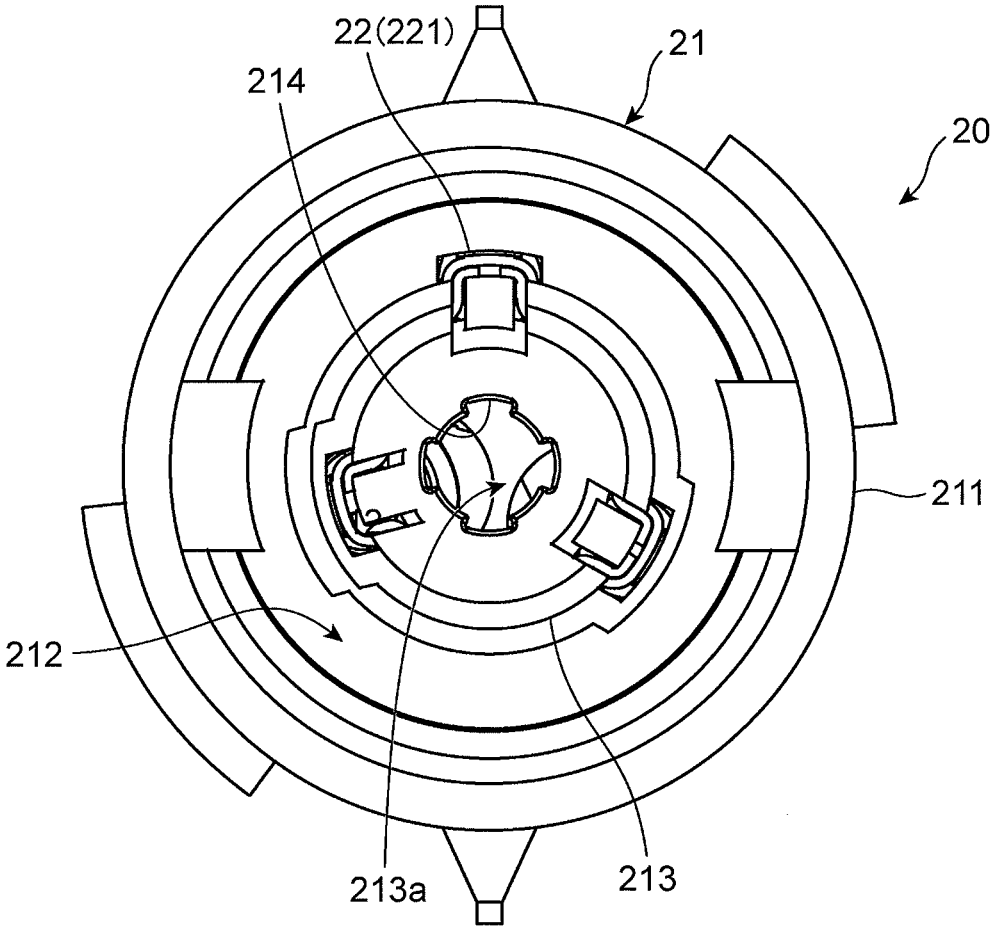
FIG. 4 is a front view of the female connector.
Figure 5:
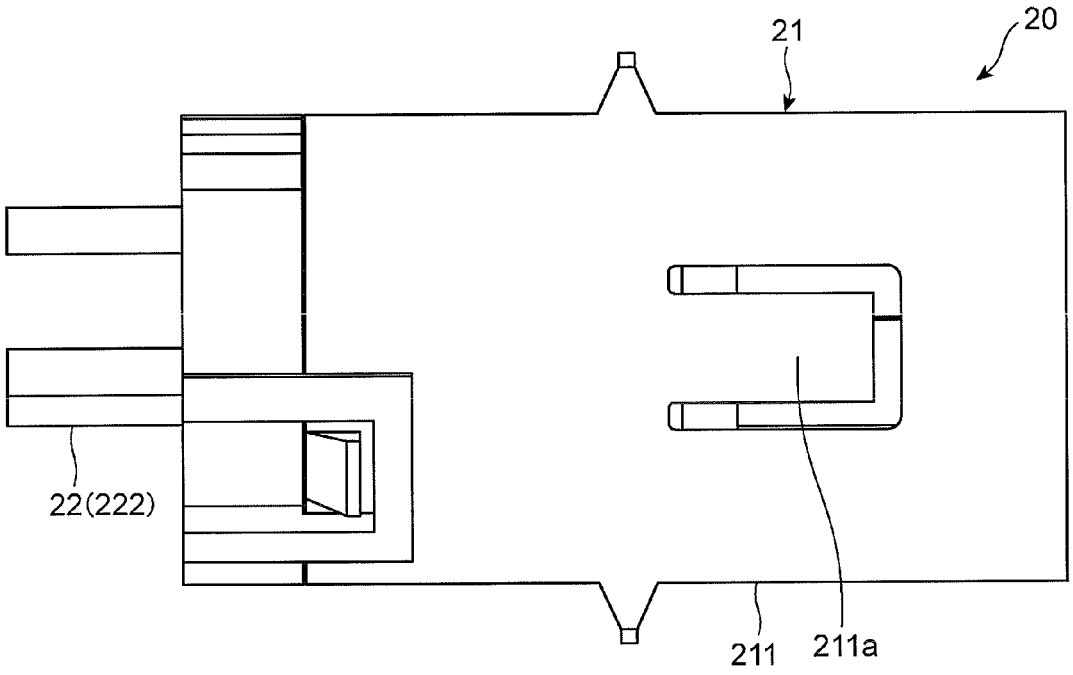
FIG. 5 is a left side view of the female connector.
Figure 6:
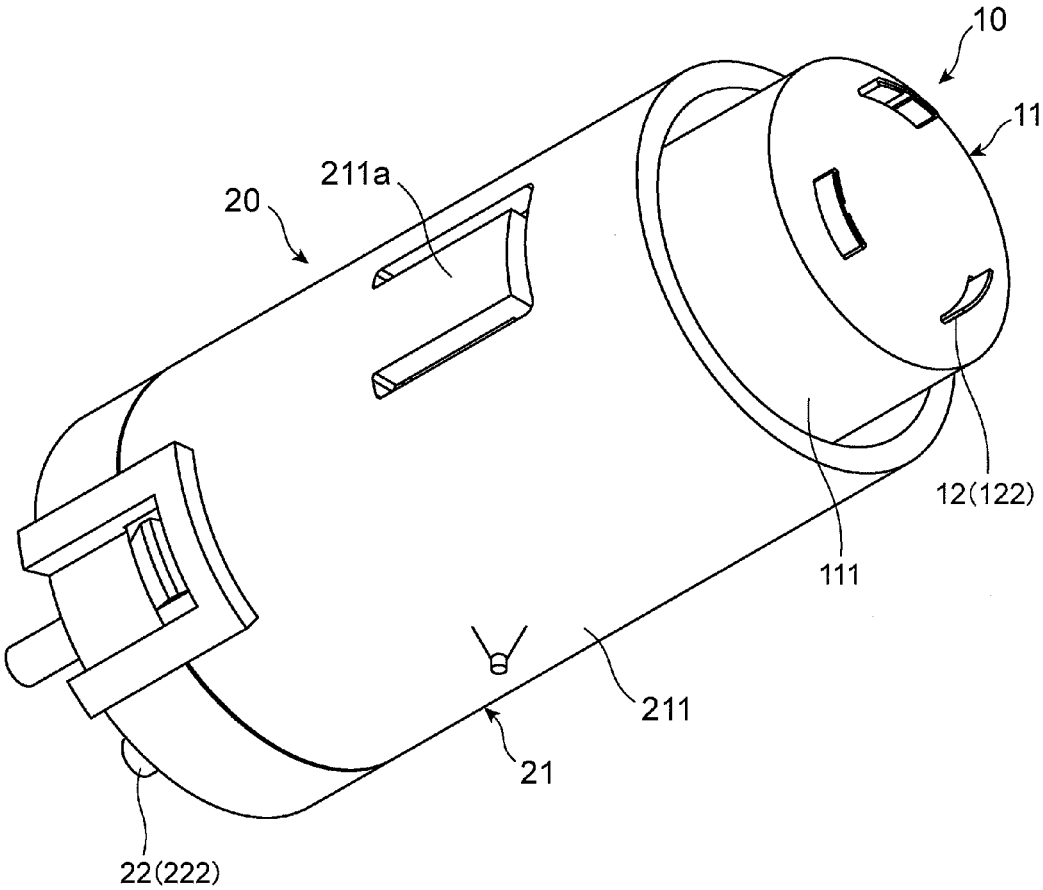
FIG. 6 is a perspective view of the male and female connectors fit into each other.

As illustrated in FIGS. 1, 4 and 5, the female connector 20 includes a female housing 21 into which the male housing 11 is fit, and three female contact terminals 22 electrically connecting the female connector 20 to the male connector 10.

The female housing 21 includes a cylindrical main body 211 open at an end and closed at the other end to define a hollow space 212 therein, and a shaft 213 extending in a direction opposite to the direction D1.

As illustrated in FIG. 1, the main body 211 is formed with an engagement hook 211*a* to be engaged with the groove 111*a* when the male housing 11 is inserted into the hollow space 212 of the female housing 21.

The shaft 213 is cylindrical and coaxial with the hollow space 212. The shaft 213 is formed with a guide hole 213*a* extending along an axis of the shaft 213. As illustrated in FIG. 4, the guide hole 213*a* is formed at an inner surface thereof with four grooves 214 circumferentially equally spaced apart from each other around an axis of the shaft 213. Specifically, the grooves 214 are formed at an inner surface of the guide hole 213*a* at every 90 degrees around an axis of the shaft 213 corresponding to the projections 114.

The female contact terminal 22 is comprised of a linear terminal designed to make mechanical and electrical contact with the male contact terminal 12. As illustrated in FIG. 4, the female contact terminals 22 are situated on an outer surface of the shaft 213 at different distances around an axis of the shaft 213. Each of the three female contact terminals 22 makes mechanical and electrical contact with each of the three male contact terminals 12. Each of the female contact terminals 22 includes a contact 221 situated on an outer surface of the shaft 213 and having a substantially U-shaped cross-section, and a connector 222 extending outwardly of the female housing 21 from a rear end of the contact 221 (see FIG. 5). The connector 222 is connected to a cable (not illustrated).

As illustrated in FIGS. 1 and 6 to 8, when the male connector 10 is fit into the female connector 20, the main body 111 of the male connector 20 is inserted into the hollow space 212 of the female housing 21, the shaft 213 of the female connector 20 is inserted into the hollow space 112 of the male housing 11, and the guide shaft 113 is inserted into the guide hole 213*a*. Concurrently, the contacts 121 of the male contact terminals 12 make mechanical and electrical contact with the contacts 221 of the female contact terminals 22.

When the male connector 10 is inserted into the female connector 20, even if the male connector 10 is attempted to be inserted in an inclined condition into the female connector 20, it is possible to insert the male connector 10 in an accurate position into the female connector 20, because the guide shaft 113 is inserted into the guide hole 213*a* of the shaft 213. Thus, the male connector 10 can be inserted into the female connector 20 with axes thereof being coincident with each other, ensuring it possible to prevent the male connector 10 inclining relative to an axis thereof from being inserted into the female connector 20, and the male connector 10 from being thrust into the female connector 20.

Accordingly, the male connector 10 can be fit into the female connector 20 without damaging the male contact terminals 12 and/or the female contact terminals 22, ensuring enhancement in reliability to the electrical connection between the male connector 10 and the female connector 20.

Furthermore, since the projections 114 are formed on an outer surface of the guide shaft 113, and the grooves 214 are formed on an inner surface of the guide hole 213*a* of the shaft 213, as illustrated in FIG. 1, it is possible to prevent the guide shaft 113 from axially rotating, that is, rotating around an axis of the male housing 11, when the guide shaft 113 is inserted into the guide hole 213*a* of the shaft 213. Accordingly, it is possible to prevent the male contact terminals 12 and the female contact terminals 22 from rubbing each other due to the axial rotation of the male connector 10 and/or the female connector 20, and further, to avoid the male contact terminals 12 and the female contact terminals 22 from being damaged, ensuring further enhancement in reliability to the electrical connection between the male connector 10 and the female connector 20.

Furthermore, since the projections 114 are formed at a position away from a top end of the guide shaft 113, the projections 114 do not interfere with the guide hole 213*a* when the guide shaft 113 is inserted into the guide hole 213*a* of the shaft 213. Thus, the guide shaft 113 can be aligned with the guide hole 213*a*, ensuring that the guide shaft 213 can be smoothly inserted into the guide hole 213*a*.

The positional relation between the projection 114 and the groove 214 is explained hereinbelow with reference to FIGS. 8 to 13. It should be noted that FIGS. 9 to 13 illustrate a big gap in exaggeration between the projection 114 and the groove 214, but the actual gap is quite small. Namely, the projection 114 and the groove 214 make partial contact with each other.

Figure 8:
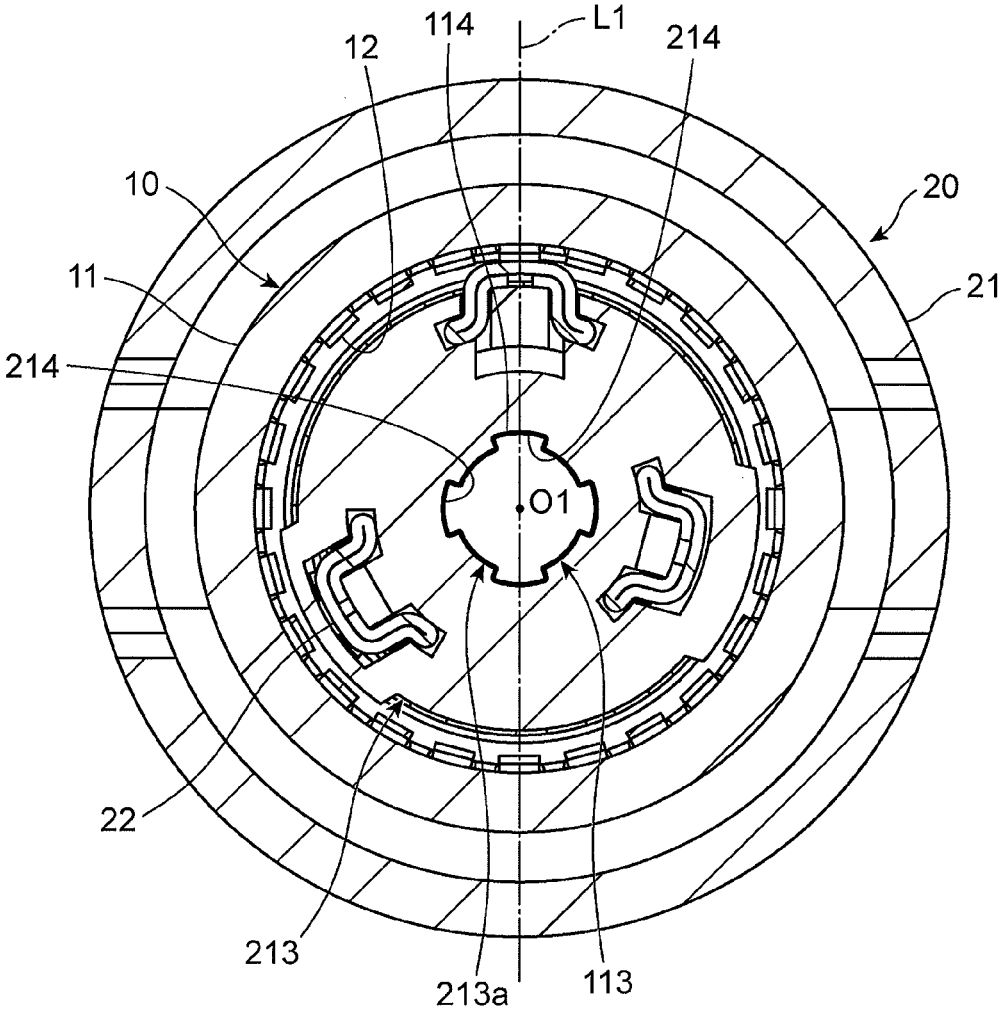
FIG. 8 is a longitudinal cross-sectional view of the male and female connectors fit into each other.
Figure 9:
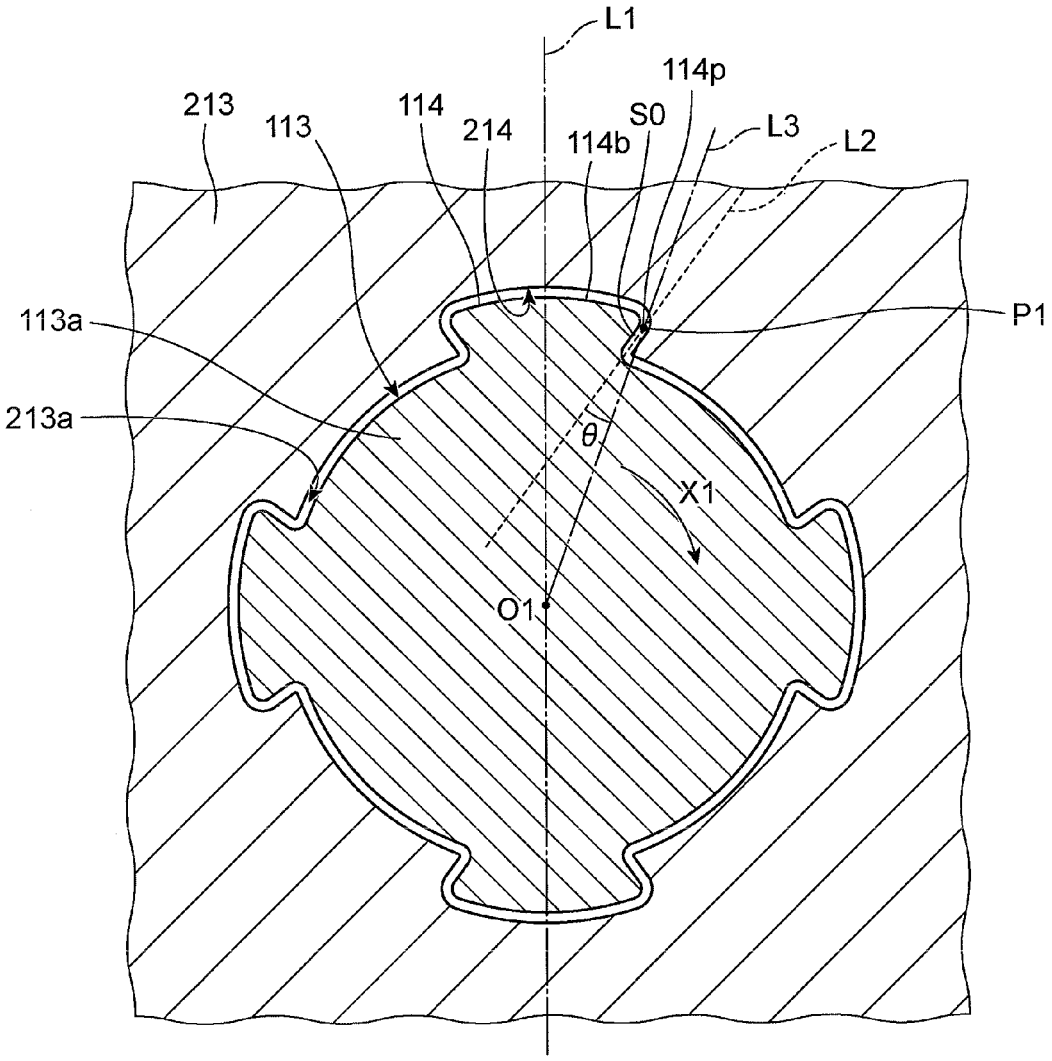
FIG. 9 is a partially enlarged view of the guide shaft and the guide hole into which the guide shaft is inserted.

As illustrated in FIGS. 8 and 9, the projection 114 and the groove 214 are located in line-symmetry with each other about a second imaginary line L1 (defined as a second imaginary line in claims) in a plane perpendicular to an axis of the guide shaft 113. Herein, the second imaginary line L1 is defined as a line extending radially of (diametrically across) the guide hole 213*a* (or the guide shaft 113) and passing through a center O1 of the axes of the guide shaft 113 and the shaft 213. Thus, the imaginary line L1 is coincident with an imaginary line bisecting a top (outer) surface 114*b* of the projection 114 and extending towards the center O1, and further coincident with a line perpendicularly bisecting either a line extending between opposite upper ends 114*p* of the projection 114 (see FIG. 10) or a line extending between opposite lower ends 114*q* of the projection 114 (see FIG. 10).

Figure 10:
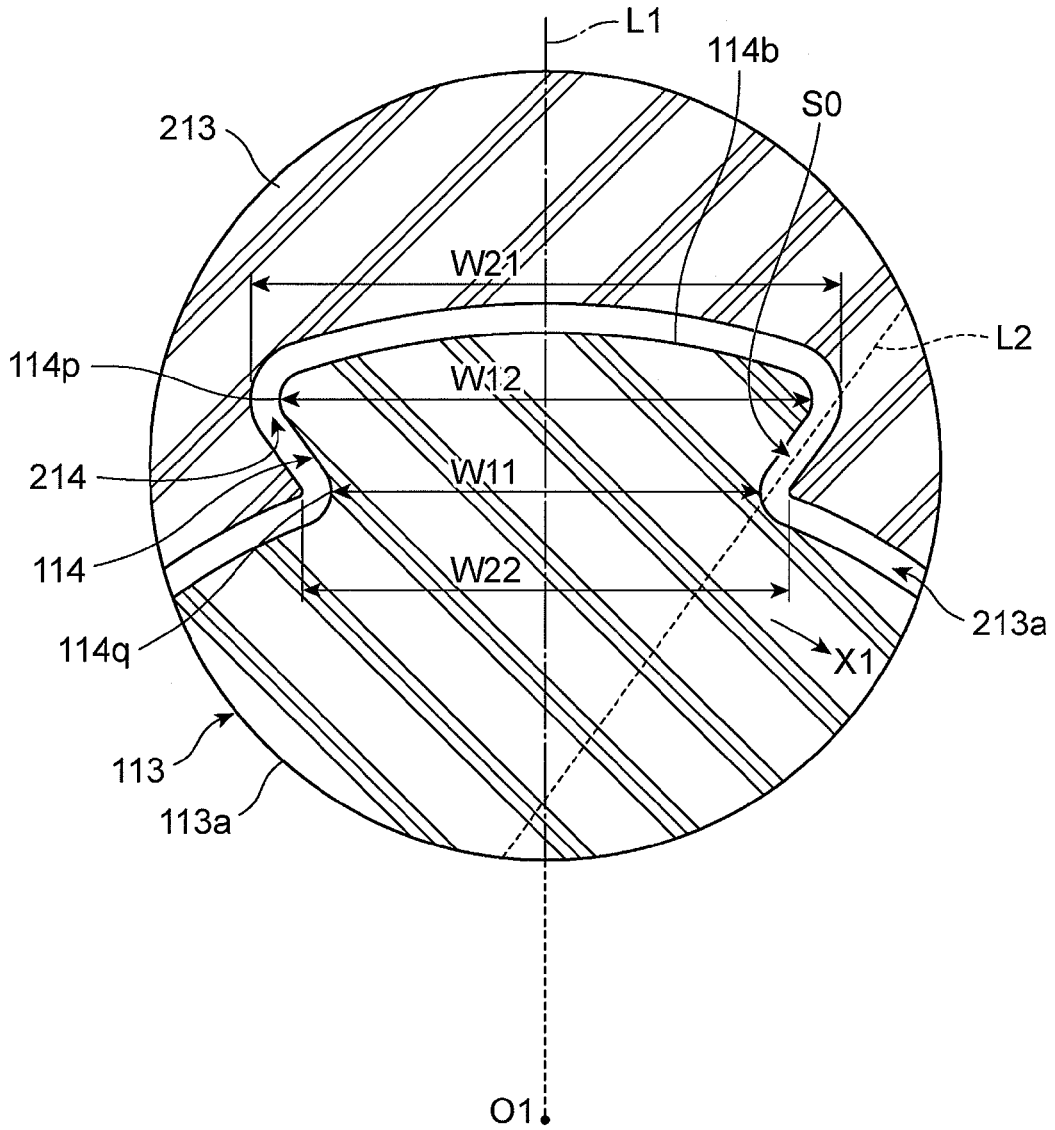
FIG. 10 is a partially enlarged cross-sectional view of the projection and the groove into which the projection is fit.

As illustrated in FIG. 10, a width W11 between the opposite lower ends 114*q* is designed smaller than a width W12 between the opposite upper ends 114*p* in the projection 114. A width W22 of an entrance to the groove 214 is greater than a width 21 of a bottom of the groove 214.

By designing the projection 114 and the groove 214 in the above-mentioned manner, as illustrated in FIG. 9, a first imaginary line L2 (defined as a first imaginary line in claims) intersects with the second imaginary line L1. Herein, the first imaginary line L2 is defined as a line extending from a contact plane S0 (a plane at which a sidewall 114*a* of the projection 114 (see FIG. 11) and a sidewall 214*a* of the groove 214 make contact with each other) located in a direction X1 of the axial rotation of the guide shaft 113, towards the center O1. Specifically, the first imaginary line L2 intersects the imaginary line L1 between the projection 114 and the center O1, as illustrated in FIG. 9.

Figure 12:
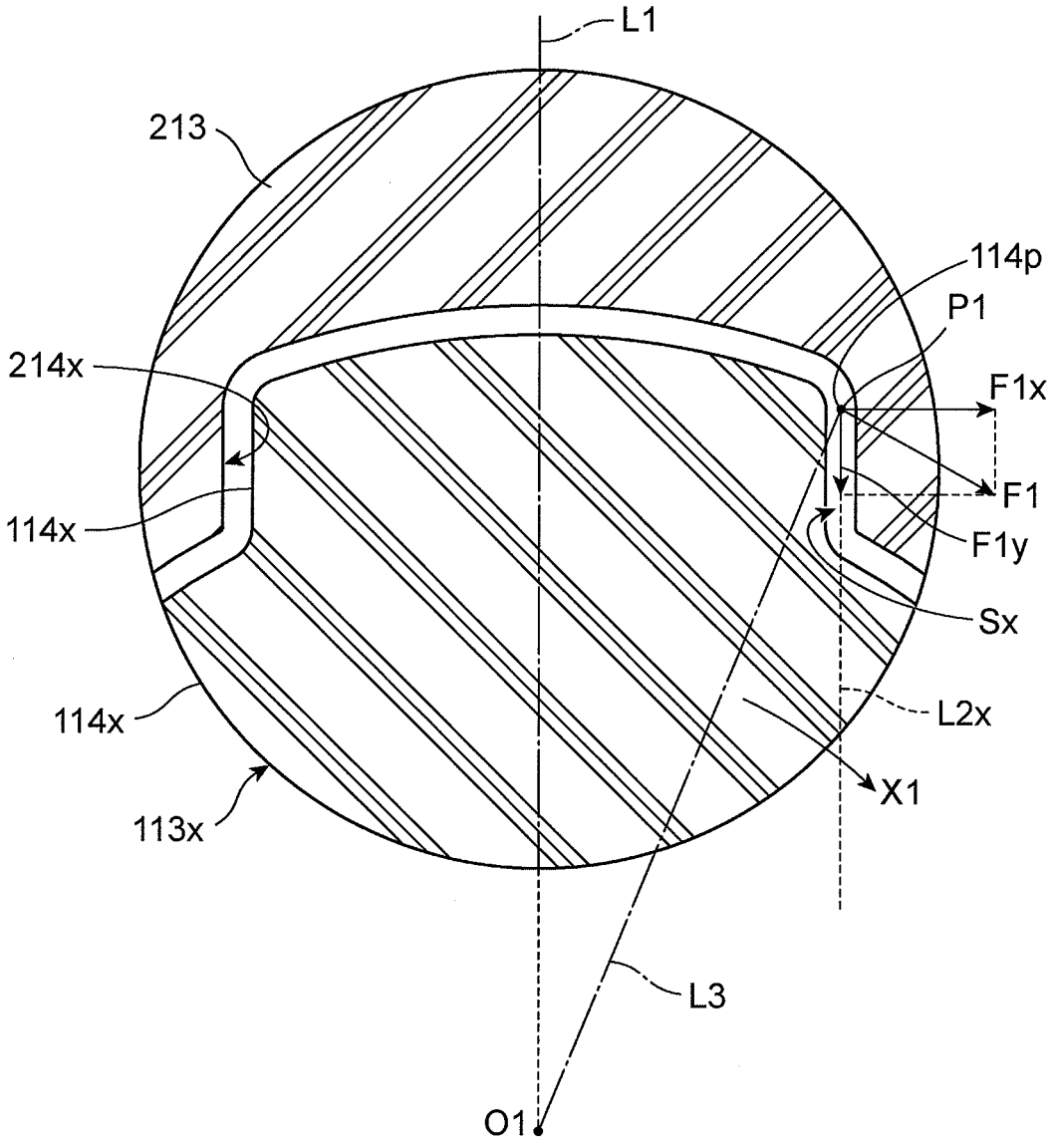
FIG. 12 is a partially enlarged cross-sectional view of the case in which an imaginary line as an extension of the contact plane does not intersect with an imaginary line bisecting the projection.

For instance, it is supposed that, as illustrated in FIG. 12, the imaginary line L2*x* defined as a line extending from the contact plane Sx towards the center O1 is in parallel with the second imaginary line L1 bisecting the projection 114*x*, and hence, does not intersect with the second imaginary line L1.

In the structure illustrated in FIG. 12, when the guide shaft 113*x* rotates, the vector F1 acting on the contact plane Sx at an outermost end P1 (an upper end 114*p*) in the direction X1 directs perpendicularly to an imaginary line L3 connecting the outermost end P1 of the contact surface Sx and the center O1 to each other. The vector F1 can be divided into a vector F1*x* indicating a force perpendicularly acting on the contact plane Sx, and a vector F1*y* indicating a force directing radially and inwardly of the guide shaft 113*x* along the imaginary line L2*x*.

Since the vector F1*y* facilitates the projection 114*x* to be released out of the groove 214*x*, the projection 114*x* can be readily collapsed, and is readily released out of the groove 214*x*. Consequently, the projection 114*x* is collapsed due to the axially rotational force, resulting in that the guide shaft 113*x* rotates in idle.

Figure 13:
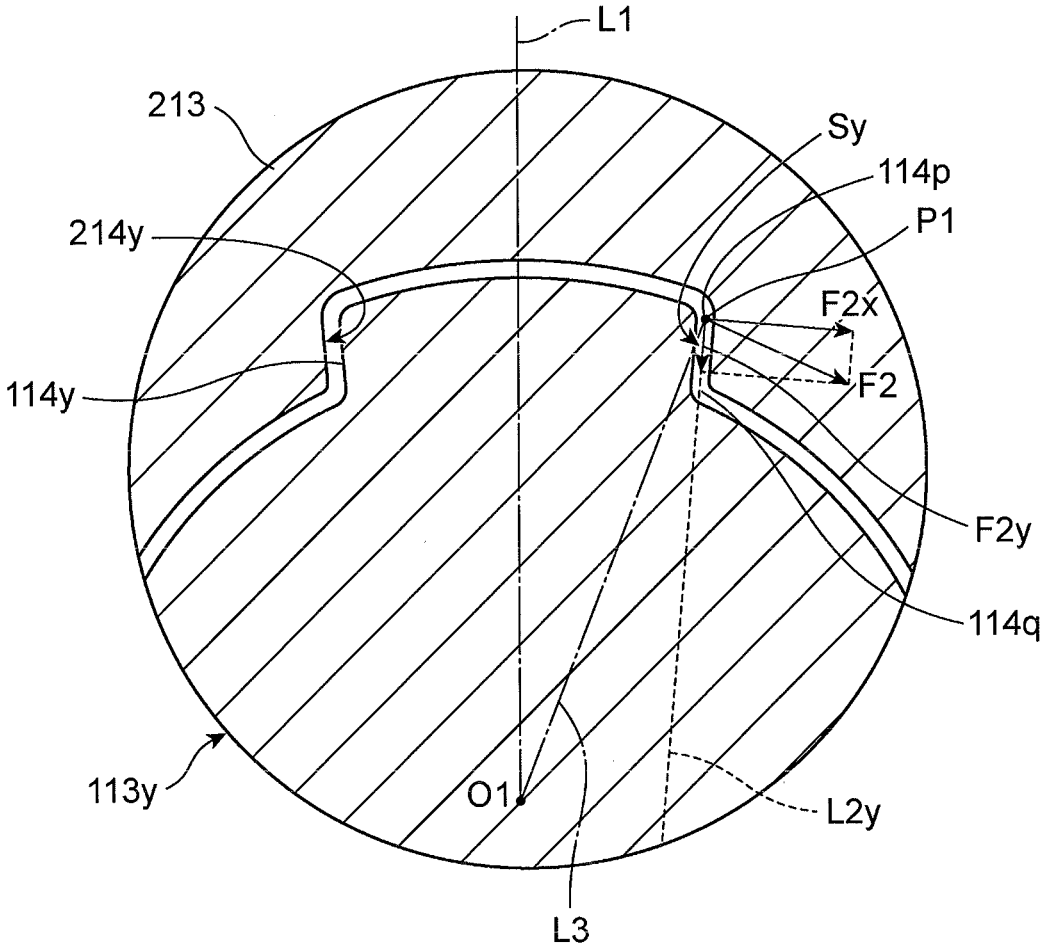
FIG. 13 is a partially enlarged cross-sectional view of the case in which an imaginary line as an extension of the contact plane intersects with an imaginary line bisecting the projection, at a location out of an area defined between the projection and a center of the guide shaft.

It is supposed that, as illustrated in FIG. 13, the imaginary line L2*y* defined as a line extending from the contact plane Sy towards the center O1 intersects with the imaginary line L1 bisecting the projection 114*y*, at a location out of an area extensive between the projection 114*y* and the center O1 (the intersection location is not illustrated in FIG. 13).

In the structure illustrated in FIG. 13, when the guide shaft 113*y* rotates, the vector F2 acting on the contact plane Sy at an outermost end P1 in the direction X1 directs perpendicularly to the imaginary line L3 connecting the outermost end P1 of the contact surface Sy and the center O1 to each other. The vector F2 can be divided into a vector F2*x* indicating a force perpendicularly acting on the contact plane Sy, and a vector F2*y* indicating a force directing radially and inwardly of the guide shaft 113*y* along the imaginary line L2*y*.

Similarly to the vector F1*y* illustrated in FIG. 12, the vector F2*y* facilitates the projection 114*x* to be released out of the groove 214*x*. However, as illustrated in FIG. 13, since the contact plane Sy is defined such that the imaginary line L2*y* intersects with the imaginary line L1, the vector F2*y* is smaller than the vector F2*x* illustrated in FIG. 12.

Furthermore, since the contact plane Sy inclines away from the imaginary line L1 in a direction towards the upper ends 114*p* from the lower ends 114*q*, the contact plane Sy can be inclined to a greater degree than the contact plane Sx illustrated in FIG. 12. Accordingly, if the projection 114*x* illustrated in FIG. 12 has a height equal to the same of the projection 114*y* illustrated in FIG. 13, the contact plane Sy can have a greater area than an area of the contact plane Sx. Thus, the projection 114*y* and the groove 214*y* both illustrated in FIG. 13 can be more firmly engaged to each other than those illustrated in FIG. 12.

Figure 14:
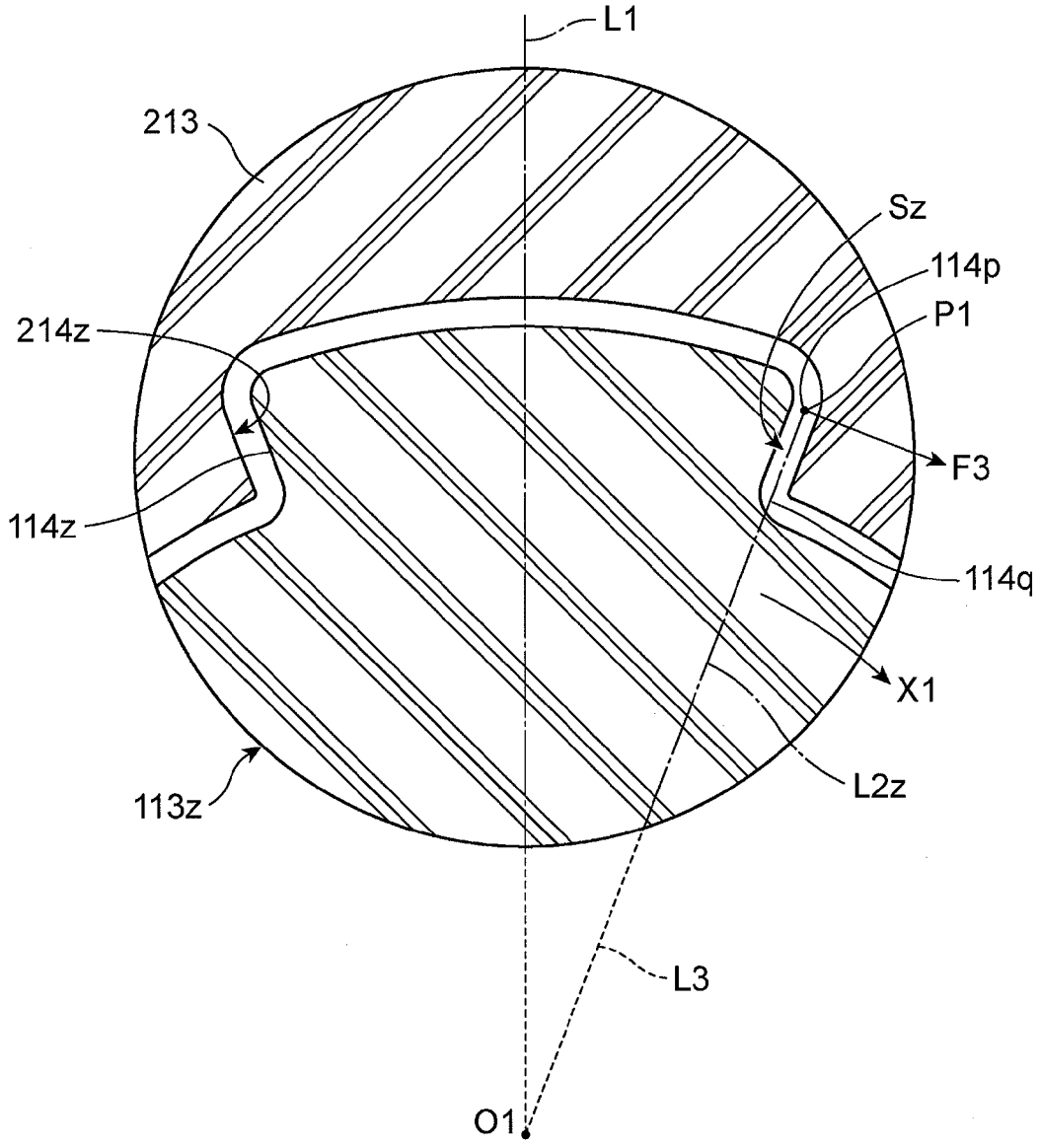
FIG. 14 is a partially enlarged cross-sectional view of the case in which an imaginary line as an extension of the contact plane intersects with a center of the guide shaft.
Figure 15:
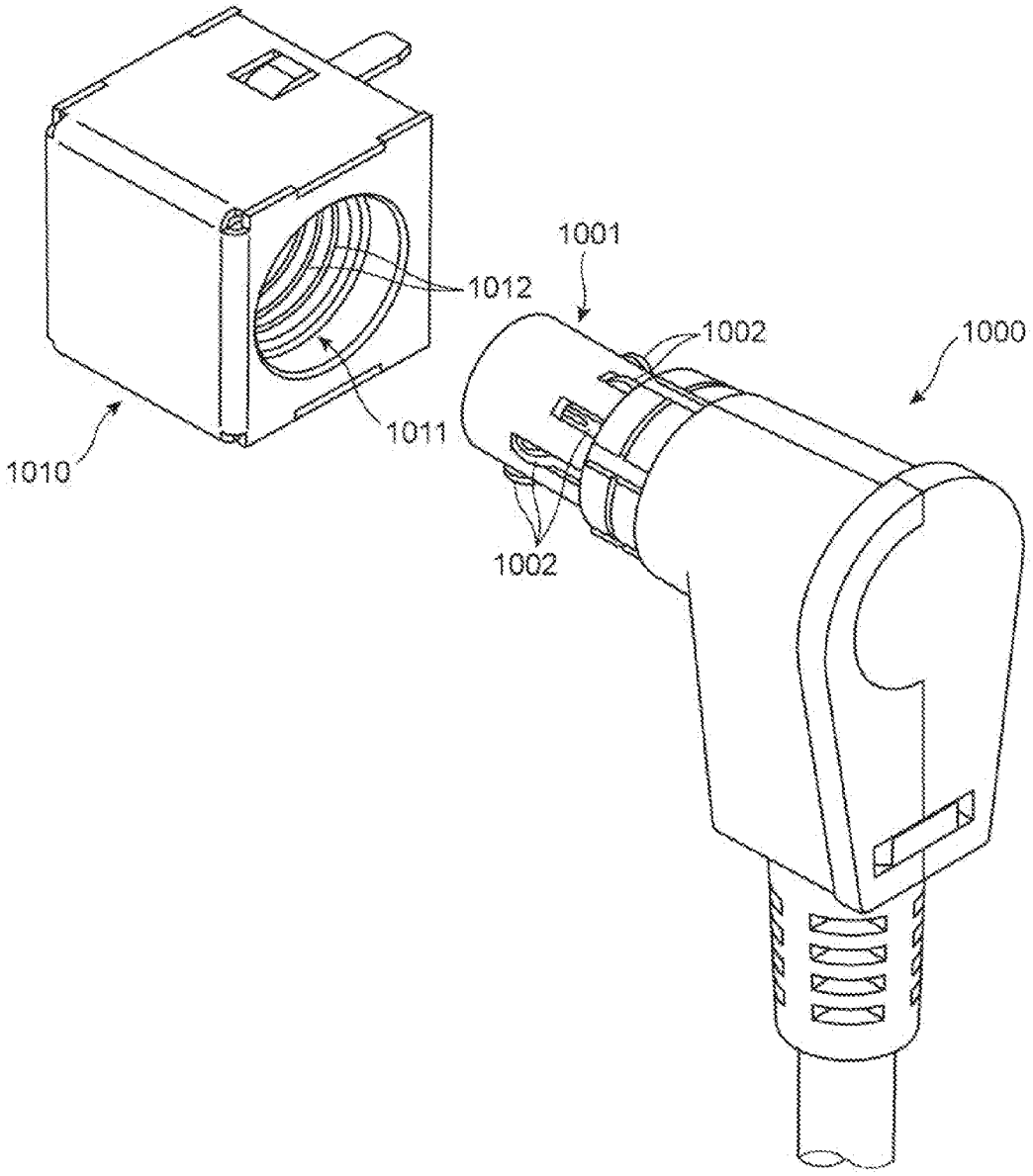
FIG. 15 PRIOR ART
FIG. 15 is a perspective view of the conventional electric connector.
Figure 16:
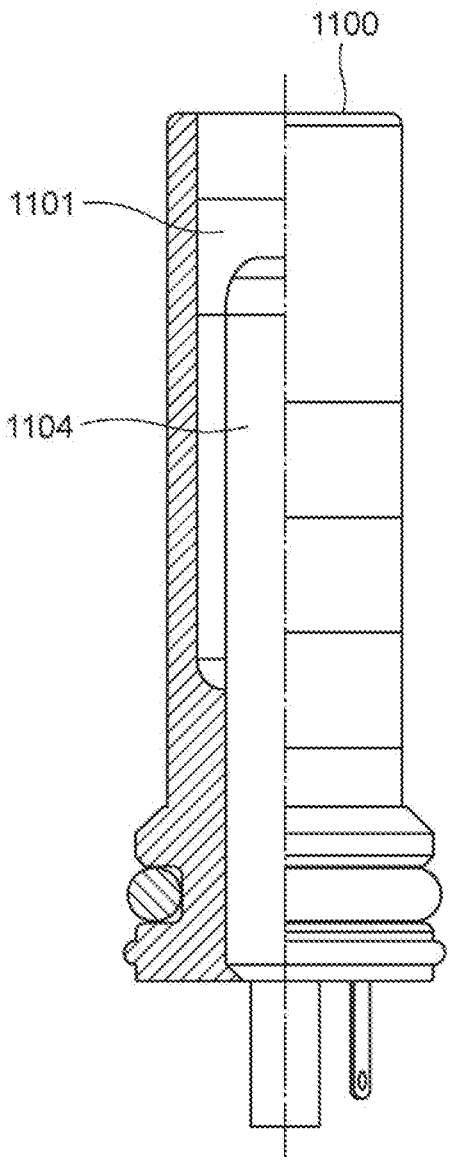
FIG. 16 PRIOR ART
FIG. 16 is a partial cross-sectional view of another conventional electric connector.
Figure 17:
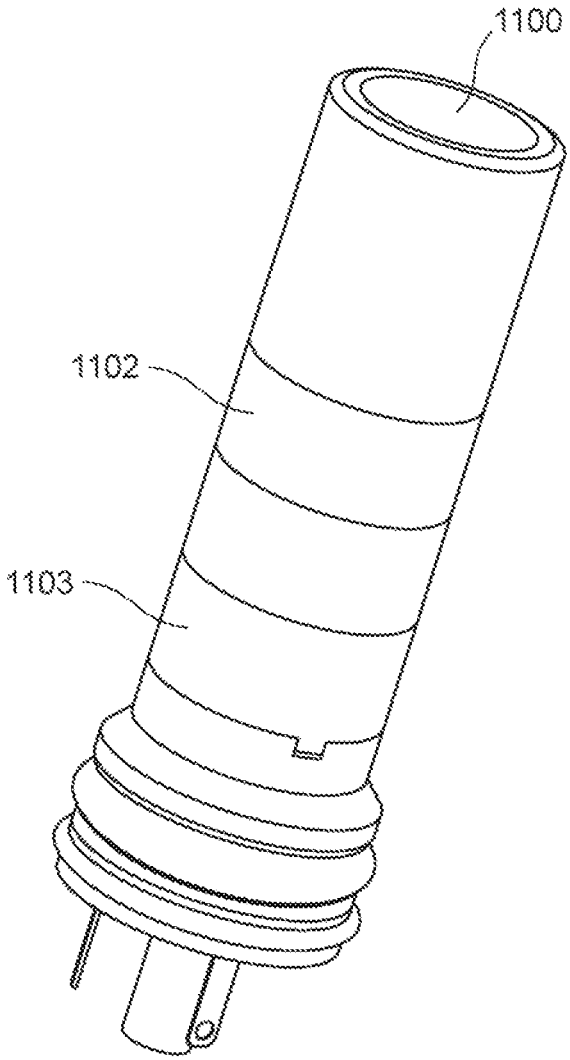
FIG. 17 PRIOR ART
FIG. 17 is a perspective view of the conventional electric connector illustrated in FIG. 16.

It is supposed that, as illustrated in FIG. 14, the imaginary line L2*z* defined as a line extending from the contact plane Sz towards the center O1 intersects with the imaginary line L1, at the center O1.

In the structure illustrated in FIG. 14, when the guide shaft 113*z* rotates, the vector F3 acting on the contact plane Sz at an outermost end P1 (an upper end 114*p*) in the direction X1 directs perpendicularly to the imaginary line L3 connecting the outermost end P1 of the contact surface Sz and the center O1 to each other. The vector F3 is comprised only of a force acting perpendicularly on the contact plane Sz. Accordingly, the vector F3 acting on the contact plane Sz in the direction X1 and the force acting on the contact plane Sz direct in the same direction, or the vector F3 and the force are identical with each other as a vector. Hence, a divided force along the contact plane Sz is not generated. Thus, it is possible to make it difficult for the projection 114*z* to be released out of the groove 214*z*.

As explained above, by designing the contact plane Sz such that the imaginary line L2 intersects with the center O1 on which the imaginary line L1 passes, the structure illustrated in FIG. 14 can keep the projection 114*z* and the groove 214*z* engaged to each other more firmly than the structure illustrated in FIG. 13.

Figure 11:
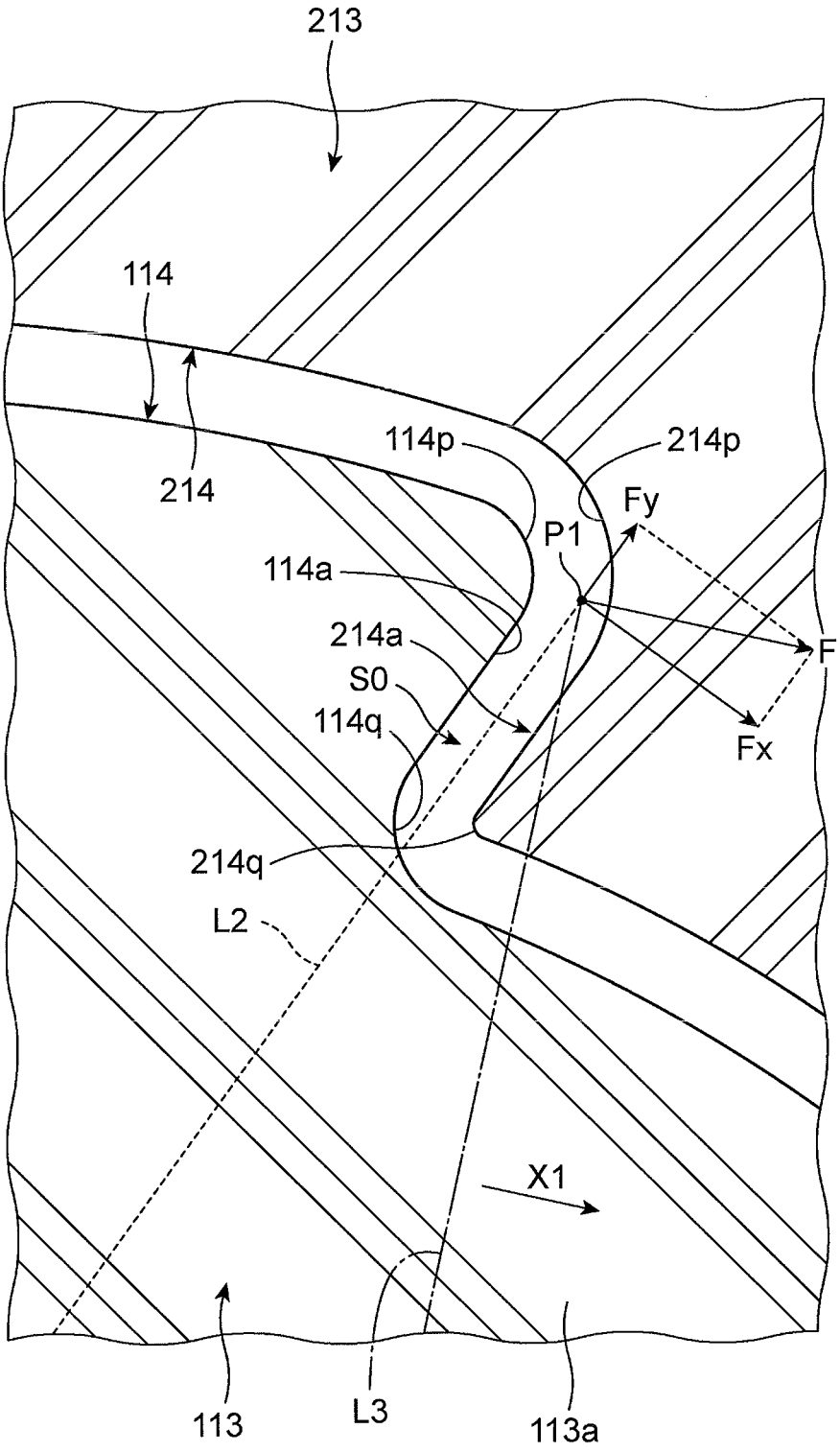
FIG. 11 is a partially enlarged cross-sectional view of a contact plane at which the projection and the groove make contact with each other.

In FIG. 9, the contact surface S0 is designed such that the imaginary line L2 intersects with the imaginary line L1 between the projection 114 and the center O1. The vector F acting on the contact plane S0 at the outermost end P1 (the upper end 114*p*) in the direction X1, indicative of a force acting on the contact plane S0 when the guide shaft 113 axially rotates relative to the shaft 213, directs perpendicularly to the imaginary line L3 connecting the outermost end P1 and the center O1 to each other, as illustrated in FIGS. 9 and 11. The vector F can be divided into a vector Fx directing perpendicularly to the imaginary line L2, and a vector Fy directing radially and outwardly of the guide shaft 113 along the imaginary line L2.

Thus, the vector Fx acts as a force acting perpendicularly on the contact plane S0, and the vector Fy acts as a force pushing and compressing the projection 114 onto a corner defined by a sidewall and a bottom of the groove 214.

By designing the contact surface S0 such that the imaginary line L2 intersects with the imaginary line L1 between the projection 114 and the center O1, as illustrated in FIG. 9, the projection 114 makes action of intruding on the groove 214 even if the guide shaft 113 attempts to axially rotate, the projection 114 is hard to be collapsed, and further, it is possible to keep the projection 114 and the groove 214 firmly engaged to each other. Since the guide shaft 113 is surely in mesh with the shaft 213, the male contact terminals 12 and the female contact terminals 22 can keep in contact with each other. Hence, the stable electrical connection can be accomplished between the male connector 10 and the female connector 20. Thus, the male connector 10 and the female connector 20 in the electric connector in accordance with the first embodiment can have an increased proof stress or resistance in the direction of the axial rotation, ensuring enhancement in reliability to the electrical connection between the male connector 10 and the female connector 20.

By designing the projection 114 to have a greater height or designing the groove 214 to have a greater depth, the projection 114 and the groove 214 can be more intensively in mesh with each other, and the projection 114 can be prevented from collapsing even when the guide shaft 113 axially rotates, ensuring that the projection 114 and the groove 214 can be kept stably engaged to each other. However, it is quite difficult or almost impossible to have a space in an electric connector recently attempted to be down-sized more and more for designing the projection 114 to have a greater height or designing the groove 214 to have a greater depth. If the projection 114 were designed to have a small height or the groove 214 were designed to have a small depth, since the housings 11 and 21 are made of resin and, therefore, have a small mechanical strength, the projection 114 would be readily collapsed, and further, could not prevent the axial rotation.

Since the contact planes S0, Sy and Sz illustrated in FIGS. 9, 13 and 14, respectively, are inclined relative to the contact plane Sx illustrated in FIG. 12 or relative to the imaginary line L1, even if the projections 114, 114*y* and 114*z* were designed to be identical in height to one another, the contact planes Sy, Sz and S having a greater inclination in this order can be designed to have a greater contact area in this order.

The contact planes Sy, Sz and S0 have a greater inclination in this order relative to the contact plane Sx extensive in parallel with the imaginary line L1. Since a divided force to cause the projections 114, 114*y* and 114*z* to be released out of the grooves 214, 214*y* and 214*z*, respectively, is smaller in this order, it is harder for the projections 114, 114*y* and 114*z* to be released out of the grooves 214, 214*y* and 214*z*, respectively, in an order of the contact planes Sy, Sz and S0.

As illustrated in FIG. 9, assuming that the inclination angle of the contact plane S0 is defined as an angle θ formed by the imaginary line L2 indicative of the contact plane S0 and the imaginary line L3, it is preferable that the angle θ is in the range of 10 to 30 degrees both inclusive. If the angle θ is smaller than 10 degrees, the projection 114 and the groove 214 are slightly engaged to each other through the contact plane S0 (defined as a plane extensive from both the upper ends 114*p* of the sidewall 114*a* of the projection and the bottom 214*p* of the sidewall 214*a* of the groove 214 to both the lower ends 114*q* of the sidewall 114*a* of the projection 114 and an opening edge 214*q* of the sidewall 214*a* of the groove 214), as illustrated in FIG. 11, the projection 114 may be readily collapsed due to excessive force acting on the projection 114 in the direction X1.

If the angle θ is greater than 30 degrees, the projection 114 and the groove 214 can be firmly engaged to each other. However, the upper ends 114*p* of the sidewall 114*a* of the projection 114 and the opening edge 214*q* of the sidewall 214*a* of the groove 214 cannot be prevented from having a small thickness, resulting in that the projection 114 may be readily collapsed. Thus, the angle θ is preferably set in the range of 10 to 30 degrees both inclusive.

As illustrated in FIG. 9, an angle formed by the contact plane S0 and the top surface 114*b* of the projection 114 extending from the outermost end P1 of the contact plane S0 in a direction opposite to the direction X1 is designed to be an acute angle, ensuring that the projection 114 can be firmly engaged to the groove 214.

Furthermore, since the projection 114 is designed to have the arcuate top surface 114*b*, the projection 114 can have a greater thickness at the upper ends 114*p* of the sidewall 114*a* than the projection designed to have a flat top surface. In addition, the projection 114 can be entirely formed thick in the direction X1, ensuring that the projection 114 can have an increased strength.

Furthermore, the arcuate top surface 114*b* can be readily molded with resin.

As an alternative, the projection 114 may be designed to have a flat top surface, in which case, an amount of resin for molding the projection 114 can be reduced.

The electric connector in accordance with the first embodiment is designed to include the four projections 114 and the four grooves 214. The projections 114 are arranged radially at every 90 degrees on an outer surface of the main body 113*a*. Similarly, the grooves 214 are arranged radially at every 90 degrees on an inner surface of the guide hole 213*a*. Thus, a stress acting on the groove 214 from the projection 114 when the projection 114 makes axial rotation can be uniformly dispersed. The number of the projections and the grooves is not to be limited to four. The electric connector may be designed to include two or more projections, and grooves in the same number as that of the projections. If the electric connector includes two, three or five projections and grooves, they are arranged at every 180, 120 or 72 degrees, respectively. That is, the projections and the grooves are circumferentially equally spaced away from adjacent ones, ensuring the same advantages as those provided by the four projections and the four grooves.

The guide shaft 113, 113*x*, 113*y* and 113*z* illustrated in FIGS. 9 to 14 are designed to rotate in the direction X1, that is, in a clockwise direction. It should be noted that they may be designed to rotate in a counterclockwise direction.

In the first embodiment, the male connector 10 is designed to include the guide shaft 113, and the female connector 20 is designed to include the shaft 213 formed with the guide hole 213*a* into which the guide shaft 113 is fit. As an alternative, the male connector 10 may be designed to include the shaft 213, and the female connector 20 may be designed to include the guide shaft 113.

The present invention is embodied in the electric connector including the male connector 10 and the female connector 20. It should be noted that the present invention may be embodied in a general combination of a shaft and a hole into which the shaft is fit.

INDUSTRIAL APPLICABILITY

The electric connector in accordance with the present invention may be employed in various fields such as the electric/electronic industry and the automobile industry, as an electric connector to be used for electric/electronic devices or an electric connector to be equipped in an automobile. For instance, the electric connector in accordance with the present invention may be applied to a connector suitable for a glow plug, a connector for connecting a combustion pressure sensor with a wire harness, or a connector connecting cables to each other While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-210358 filed on Oct. 7, 2013 including specification, claims, drawings and summary is incorporated herein by reference in its entirety.

What is claimed is:

1. A combination of a shaft and a hole into which said shaft can be inserted, wherein said shaft has a main body, and has a projection radially projecting from said main body, wherein said hole has an inner surface, and said inner surface has a groove into which said projection is fit, wherein said projection and said groove are formed such that:

a first imaginary line is defined by extending a contact plane at which said projection and said groove make contact with each other when said shaft rotates relative to said hole, towards a center of said shaft, and a second imaginary line is defined as a line bisecting a top surface of said projection and extending towards said center of said shaft, said first imaginary line intersects with said second imaginary line between said projection and said center of said shaft.

2. The combination as set forth in claim 1, wherein said shaft includes a plurality of projections, and said hole is formed with a plurality of grooves, and wherein said projections are equally spaced apart from each other, and said grooves are equally spaced apart from each other.

3. The combination as set forth in claim 1, wherein said projection has an arcuate top surface.

4. The combination as set forth in claim 1, wherein said projection is formed on an outer surface of said main body of said shaft, and said groove is formed in an inner surface of said hole.

5. An electric connector comprising:

a first housing including a guide shaft; and a second housing including a guide hole into which said guide shaft is inserted, wherein said guide shaft has a main body, and has a projection radially projecting from said main body, wherein said guide hole has an inner surface, and said inner surface has a groove into which said projection is fit, wherein said projection and said groove are formed such that:

a first imaginary line is defined by extending a contact plane at which said projection and said groove make contact with each other when said first housing rotates relative to said second housing, towards a center of said guide shaft, a second imaginary line is defined as a line bisecting a top surface of said projection and extending towards said center of said guide shaft, and said first imaginary line intersects with said second imaginary line between said projection and said center of said guide shaft.

6. The electric connector as set forth in claim 1, wherein said guide shaft includes a plurality of projections, and said guide hole is formed with a plurality of grooves, and wherein said projections being equally spaced apart from each other, and said grooves being equally spaced apart from each other.

7. The electric connector as set forth in claim 1, wherein said first housing comprises a housing of a male connector, and said second housing comprises a housing of a female connector, wherein said guide shaft extends in said first housing, and wherein said guide hole is formed along an axis of a shaft extending in said second housing.

8. The electric connector as set forth in claim 5, wherein said projection has an arcuate top surface.

9. The electric connector as set forth in claim 5, wherein said first imaginary line and a third imaginary line connecting an outermost end of said projection and said center of said guide shaft with each other form an angle in a range of 10 degrees to 30 degrees both inclusive.

10. The electric connector as set forth in claim 1, wherein said contact plane and said top surface of said projection form an acute angle.

11. The electric connector as set forth in claim 5, wherein said projection is formed on an outer surface of said main body of said guide shaft, and said groove is formed in an inner surface of said guide hole.

* * * * *